SPANNER BEAM HANGER ASSEMBLY

BACKGROUND AND SUMMARY OF THE INVENTION

This invention relates to a reusable hanger assembly for temporarily supporting a spanner beam during the construction of bridge decks and other elevated concrete slabs.

The forms normally used in construction projects to support the concrete while it hardens include wooden spanner beams and plywood panels. The spanner beams are suspended on hangers between the main structural girders and the plywood panels are installed on top of the spanner beams to provide a flat surface for receiving the concrete. After the concrete has hardened sufficiently to become self-supporting, the forms are disassembled and removed for further use.

The types of hangers currently used to support the spanner beams suffer from various disadvantages, such as structural weakness, high cost, and assembly difficulties. Also, since most existing hangers receive the spanner beam relatively loosely, the assembled forms lack rigidity and are able to shift in position or even collapse when the concrete is poured. Known hangers are further unsatisfactory in that the disassembly and removal of the forms requires considerable time and effort and often results in damage to the forms. More importantly, the disassembly or "wrecking" of the forms involves danger to the workmen because the spanner beams and plywood panels are released together and the entire bulk of the forms must therefore be handled simultaneously.

In one type of prior art hanger, the spanner beam is received in a bracket and supported on a tapered wedge member which is inserted beneath the spanner beam by wedging action. The main disadvantage of this type of hanger is its lack of stability, since the weight of the concrete exerts a force which tends to work the wedge member out of the bracket. As a result, the forms are likely to collapse unless the wedge member is driven in so tightly that its removal is difficult, in which case the time, trouble and danger involved in disassembling the forms is increased substantially.

A further deficiency in the prior art is the lack of a practical maans for varying the haunch of the concrete slab, or its elevation relative to the main structural beams or girders. Existing hanger assemblies typically support the spanner beam at a constant elevation with respect to the girders so that the haunch also remains constant, even though the vertical deflection of the girders varies along their lengths. The concrete slab is therefore not level throughout its length, a result that is particularly undesirable in bridges having a lengthy span because of the large girder deflection near the center of the bridge. Even those hangers that permit haunch variation support the spanner beam only at discrete or stepped levels so that vertical adjustment throughout a continuous range is not achieved.

In view of the foregoing drawbacks associated with existing spanner beam hangers, it is the primary goal of the present invention to provide an improved hanger assembly for supporting the forms used in the construction of elevated concrete slabs such as bridge decks and the like.

More specifically, it is an object of the invention to provide a hanger assembly which supports a spanner beam in a rigid position between a pair of spaced girders. It is an important feature of the invention that each end of the spanner beam is tightly retained in the hanger assembly such that the hangers, spanner beams, and girders form a rigid structure in the assembled condition.

In conjunction with the preceding object, it is a further object of the invention to provide a hanger assembly of the character described that supports the spanner beam with increased stability and resists any tendency of the spanner beam to release when the concrete is poured.

Another object of the invention is to provide a hanger assembly of the character described which permits the assembly and disassembly of the forms to be carried out quickly, easily and safely.

Yet another object of the invention is to provide a hanger assembly of the character described that includes adjustable means for varying the haunch of the concrete slab throughout a continuous range.

A further object of the invention is to provide a hanger assembly of the character described that is economically manufactured and yet constructed ruggedly for repeated use.

DETAILED DESCRIPTION OF THE INVENTION

In the accompany drawings which form a part of the specification and are to be read in conjunction therewith, and in which like reference numerals are employed to represent like parts in the various views.

Figure 6:
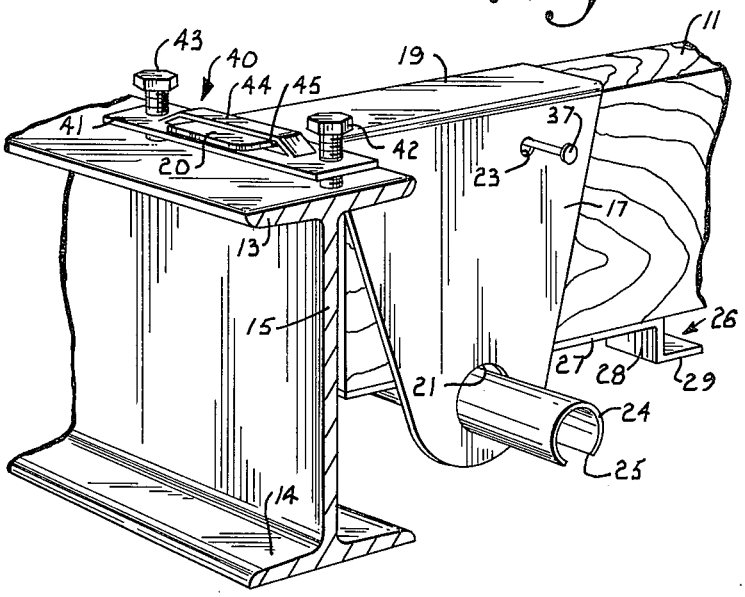
Figure 7:
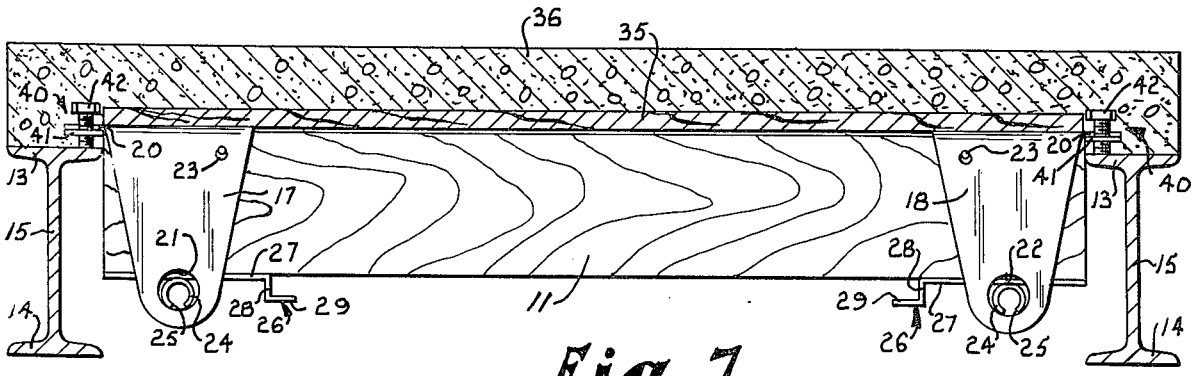

FIG. 6 is an enlarged, fragmentary perspective view showing a hanger assembly and leveling mechanism in position to support one end of the spanner beam from an I-beam; and FIG. 7 is an elevational view taken in cross section through spaced I-beams and showing a pair of hanger assemblies and leveling mechanisms in position to support the spanner beam between the I-beams, with a plywood panel installed on top of the spanner beam and a bridge deck formed on the plywood panel.

Figure 1:
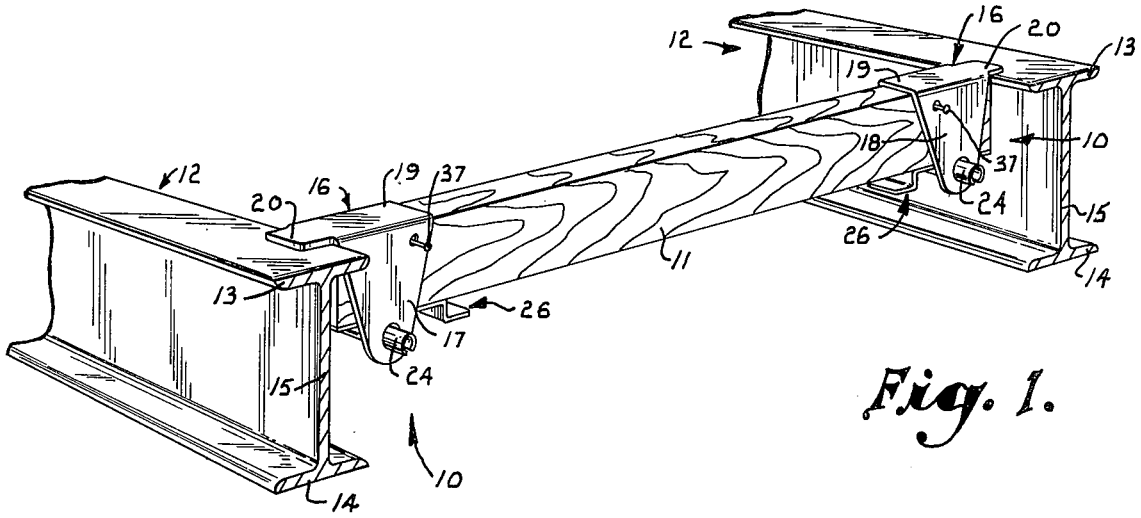
FIG. 1 is a perspective view of a spanner beam supported between spaced I-beam girders by a pair of hanger assemblies constructed in accordance with a preferred embodiment of the invention.

Refering now to the drawings in detail and initially to FIG. 1, a pair of identical hanger assemblies constructed in accordance with the invention are each generally designated by reference numeral 10. Hanger assemblies 10 are used to support the opposite ends of a wooden spanner beam 11 such that the spanner beam extends perpendicularly between a pair of parallel I-beams 12. Each I-beam 12 includes a horizontal upper flange 13, a horizontal lower flange 14, and a vertical web 15 that interconnects flanges 13 and 14 at their centers. Spanner beam 11 is rectangular in cross section and is included in the forms that are commonly used in the construction of bridge decks and other elevated concrete slabs. The length of spanner beam 11 is such that it extends between the edges of the I-beam flanges to span the distance between the two I-beams 12.

Figure 4:
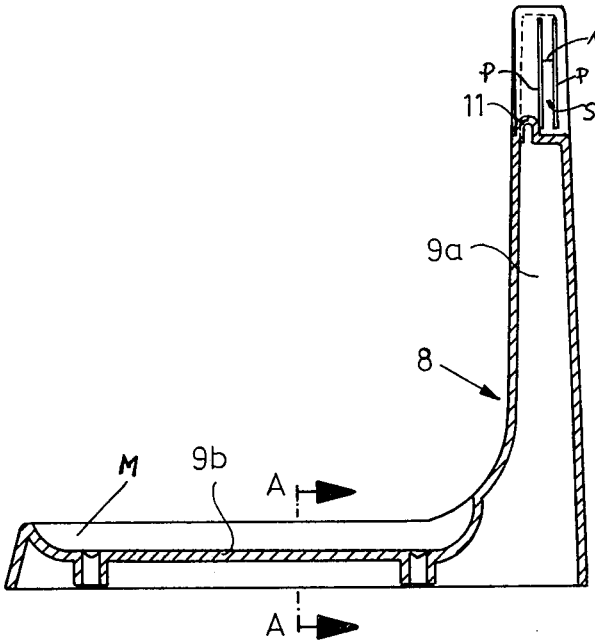
FIG. 4 is an enlarged, exploded perspective view of the components of the hanger assembly, including an adjustable leveling mechanism.

Each hanger assembly 10 includes a bracket 16 which is best illustrated in its structural details in FIG. 4. A pair of parallel side plates 17 and 18 form the opposite sides of bracket 16. Plates 17 and 18 are oriented vertically and are spaced from one another a distance slightly greater than the thickness of spanner beam 11 so that the spanner beam may be received therebetween. Plates 17 and 18 gradually taper from top to bottom and are rounded at their bottom ends. A flat, horizontal top panel 19 of rectangular shape is integral with side plates 17 and 18 and interconnects the side plates at their upper edges to form the top of bracket 16. A flat, rectangular tongue 20 is formed as a continuous extension of top panel 19 and projects horizontally a considerable distance beyond side plates 17 and 18. Respective circular openings 21 and 22 are formed in alignment with one another through the lower portions of side plates 17 and 18. The upper edge of each opening 21 and 22 is located below top panel 19 a distance slightly greater than the vertical dimension of a spanner beam inserted between the side plates 17 and 18. A small aperture 23 of a size to receive a nail is formed through each side plate 17 and 18 somewhat below the top of the plate and near one lateral edge thereof.

A beam support means comprising a rolled pin 24 is included in each hanger assembly to support spanner beam 11. The length of pin 24 is greater than the distance between side plates 17 and 18, while the size of the pin is somewhat smaller than the diameter of openings 21 and 22. The pin is generally C-shaped in section with a cylindrical exterior surface. The longitudinal edges of the pin do not meet, thereby providing a slot 25 extending throughout the length of the pin. Slot 25 provides eccentricity to the exterior surface of the pin so as to secure the spanner beam 11 with a camming action against the upper plate 19 as will be more fully explained hereinafter.

Figure 5:
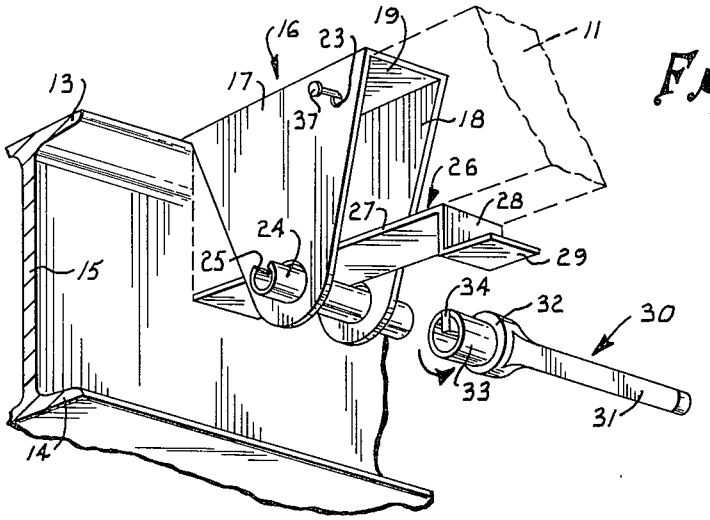
FIG. 5 is a fragmentary, perspective view of a hanger assembly positioned on an I-beam and showing the camming bar inserted beneath the spanner beam with its slot facing upwardly, the spanner beam being shown in broken lines and a tool that is useful for rotating the camming bar being illustrated.

FIG. 5 illustrates a wrench tool 30 useful to rotate the eccentric pin 24. Tool 30 includes an elongate handle 31 which terminates in an enlarged head 32. Mounted on the head 32 is a cylindrical socket 33 which is sized to fit closely around pin 24. An internal lug 34 projects inwardly from the wall of socket 33 and is sized to fit into slot 25 of pin 24.

Again with reference to FIG. 4, each hanger assembly may further include a generally Z-shaped accessory member 26. Member 26 includes a flat base 27 having a rectangular configuration and a length slightly greater than the combined length of top panel 19 and tongue 20 of bracket 16. An intermediate web 28 is connected at one edge to the end of base 27 and extends perpendicularly therefrom. The opposite edge of web 28 connects to a flat flange 29 which extends outwardly from the web at a right angle. Flange 29 is of substantially the same size and shape as the bracket tongue 20.

In use as shown in FIG. 1, one of the hanger assemblies 10 is suspended from each of the I-beams 12 to support spanner beam 11 between the I-beams with tongue 20 bearing on top of the upper I-beam flange 13 with the edges of side plates 17 and 18 contacting the edge of the flange 13. When installing a hanger assembly 10, one end of spanner beam 11 is inserted between side plates 17 and 18. Base 27 is held flatly against the bottom of spanner beam 11, and pin 24 is inserted through the plate openings 21 and 22 and beneath the spanner beam and accessory member 26. With particular reference to FIG. 5, slot 25 is oriented upwardly as pin 24 is inserted beneath the spanner beam so that sufficient clearance is presented between the flat underside of base 27 and the bottom edges of openings 21 and 22 to permit the pin 24 to easily fit through openings 21 and 22.

Figure 2:
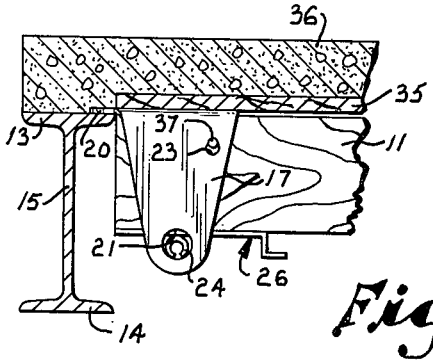
FIG. 2 is a fragmentary, elevational view taken in cross section through an I-beam and showing a hanger assembly positioned on the W-beam to support one end of the spanner beam, with a plywood panel installed on top of the spanner beam and a bridge deck formed on a plywood panel.
Figure 3:
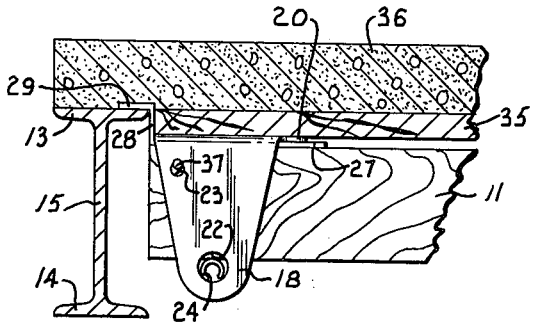
Figure 4:
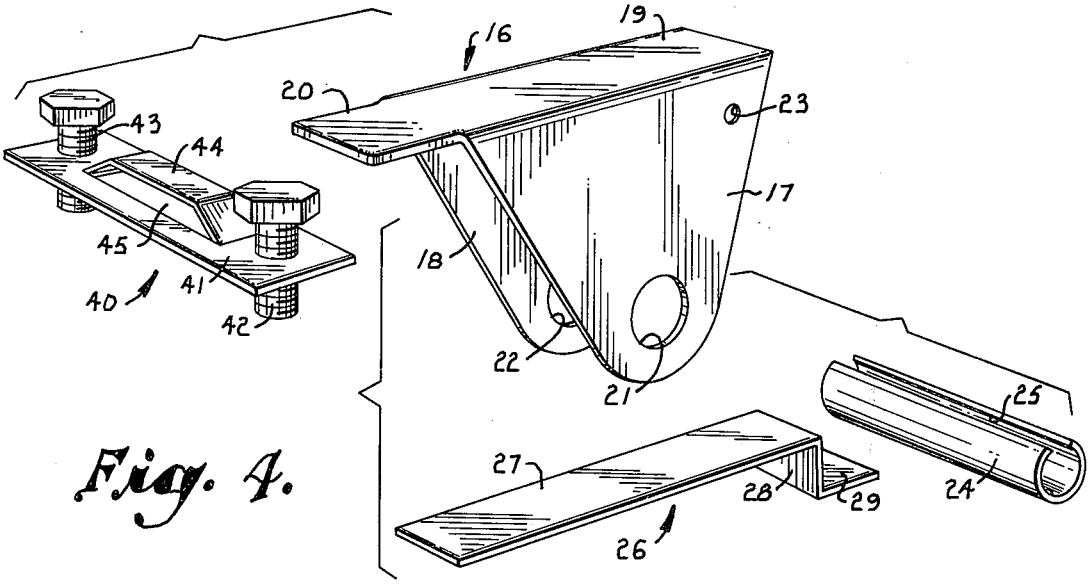

Pin 24 is thereafter rotated from the FIG. 5 position to a position such as shown in FIG. 2. A tool 30 of the nature previously described may be employed to facilitate rotation of the pin 24. With socket element 33 inserted over the end of pin 24 and lug 34 projecting into slot 25, the tool handle 31 is turned to rotate pin 24 from the FIG. 5 position, whereupon the cylindrical pin surface comes into engagement with the underside of the accessory member base 27. The resulting camming action presses spanner beam 11 upwardly against top panel 19 and tightly lodges pin 24 in a supportive position beneath the spanner beam and base 27. Spanner beam 11 is thereby rigidly retained within bracket 16 with a tight wedging fit.

It should be noted that in the application of the hanger assembly as shown in FIG. 2, member 26 is only an accessory piece and may be omitted. In such instance, the pin 24 would cam against the lower surface of the beam 11 instead of the plate 27. Although accessory member 26 is included in the foregoing description, it is primarily in a stored position in FIG. 2 and plays a more significant structural role in subsequent applications of the hanger assembly as will become apparent.

After a plurality of spanner beams have been positioned between I-beams 12, a rectangular plywood panel 35 is installed on top of the spanner beams and hanger assemblies, as shown in FIG. 2. Concrete is then poured onto panel 35 and cured to form the bridge deck 36. In the preferred embodiment, tongue 20 is ¼ inch thick and panel 35 is ¾ inch thick so that a haunch of approximately 1 inch will be formed between the top of I-beam 12 and the bottom of bridge deck 36 when the hanger assembly is employed as in FIG. 2.

Once the concrete has hardened sufficiently to become self-supporting, the hanger assemblies 10, spanner beams 11 and panel 35 are removed for further use. To disassemble the forms, pin 24 is rotated until slot 25 mates with the plate 27 or the beam 11. Pin 24 is thereby loosened somewhat and may be withdrawn from openings 21 and 22 to release spanner beam 11. For safety purposes and to temporarily support spanner beam 11 as pin 24 is withdrawn, a nail 37 may be driven into the spanner beam through aperture 23 and thereafter removed when it is desired to release the spanner beam. With the beam 11 removed, bracket 16 is then pulled away from I-beam 12 to withdraw tongue 20 from the top of flange 13 and permit removal of the bracket and the plywood panel 35. If any resistance in removing the bracket is encountered as may be caused by concrete adhering to tongue 20, this may easily be overcome by a slight wedging of the bracket to dislodge the tongue 20.

Figure 3:
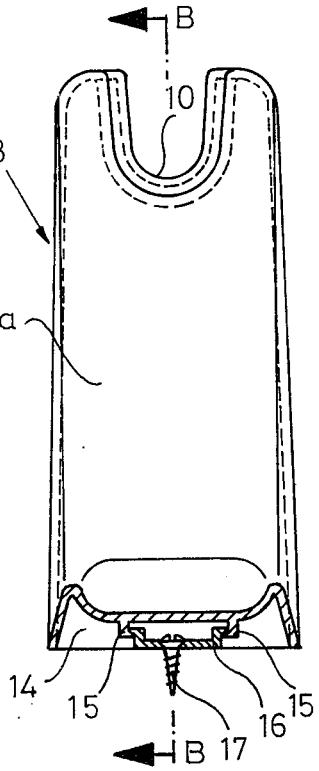
FIG. 3 is a fragmentary, elevational view similar to FIG. 2, but showing the components of the hanger assembly arranged in an alternative position to support the spanner beam below the top of the I-beam.

If the bottom of bridge deck 36 is to be at the same elevation as the top of I-beams 12, accessory member 26 may be used to suspend bracket 16 from the I-beam in the alternative position shown in FIG. 3. The flat flange 29 of member 26 is placed on top of I-beam 12 with base 27 inserted between side plates 17 and 18 such that top panel 19 rests flatly on top of the base plate 27. Spanner beam 11 is inserted between side plates 17 and 18 and held against base 27 as pin 24 is inserted in openings 21 and 22 with slot 25 facing upwardly. Subsequent rotation of pin 24 results in camming action which presses spanner beam 11 upwardly against base 27 and tightly lodges pipe 24 beneath the spanner beam. Panel 35 is then installed and bridge deck 36 is formed in the manner previously related. The height of the web 28 is such that plywood panel 35 will rest on top of bracket 16 with the top surface of the plywood panel at the same elevation as the top surface of the upper I-beam flange 13.

In the FIG. 3 application of the hanger device, plate 29 serves the same function as tongue 20 to bear on the girder 12. The bracket 16 may be reversed (but not necessarily) so that the rear edge of plate 19 engages the web. 28 of the extension accessory 26 in FIG. 3.

To strip the forms and hanger assemblies once the concrete is set, pin 24 is rotated to orient slot 25 upwardly I-beam and permit the pin to be withdrawn from openings 21 and 22. After the spanner beam has been removed from bracket 16, the bracket is slid away from the I- beam until its top panel 19 clears the end of base 27 to separate the bracket from accessory member 26. Member 26 is then pulled or pried to withdraw its flange 29 from the concrete and permit the accessory member and panel 35 to be removed.

It is frequently desirable to vary the haunch of bridge deck 36 at certain areas, such as when the vertical deflection of I-beams 12 is considerable at their central portions. An adjustable leveling mechanism 40 is therefore included for use with hanger assemblies 10 to permit variation in the haunch of the bridge deck. Referring particularly to FIG. 4, leveling mechanism 40 includes a small rectangular plate 41. Internally threaded openings are formed through plate 41 near its opposite ends to receive screws 42 and 43. Each screw 42 and 43 has a bottom end, a threaded shank, and an enlarged hexagonal head. A metal strip 44 projects upwardly from the top surface of plate 41 at a central portion thereof and is spaced a slight distance above plate 41. Strip 44 and plate 41 thereby cooperate to present a narrow slot 45 of a size to closely but removably receive tongue 20 or flange 29.

Leveling mechanism 40 is applied on top of I-beam 12 by placing the flat bottom ends of screws 42 and 43 thereon, as shown in FIGS. 6 and 7. Plate 41 is spaced above the top of the I-beam in a horizontal orientation and may be vertically adjusted by turning screws 42 and 43 appropriately. Tongue 20 of the hanger installed on a beam as shown in FIG. 2 or extension flange 29 of the hanger installed on a beam as shown in FIG. 3 is inserted in slot 45 to support the bracket 16 and spanner beam 11. Plywood panel 35 may be placed over a plurality of assembled spanner beams to receive the concrete which forms bridge deck 36. The adjustment means provided by screws 42 and 43 permits the haunch of bridge deck 36 to be varied throughout a continuous range to compensate for increasing deflection of the girders 12 toward the centers thereof.

The removal of the forms after bridge deck 36 has hardened is carried out substantially as previously described. Pin 24 is rotated to permit withdrawal of the pin and the release of spanner beam 11. Bracket 16 is then pulled away from leveling mechanism 40 to withdraw tongue 20 (or flange 29) from slot 45. Bracket 16 and plywood panel 35 are removed for further use, although leveling mechanism 40 remains embedded in the concrete.

For illustrative purposes, the use of hanger assemblies 10 has been described in connection with the construction of a bridge deck. However, it is to be understood that the hanger assemblies are equally useful in the construction of any type of elevated concrete slab which employs spanner beams to support temporary forms.

From the foregoing it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described my invention, I claim:

1. A hanger assembly for supporting a beam member from a support surface, said assembly comprising:

a bracket having a pair of parallel side plates spaced apart sufficiently to receive therebetween the beam member at the end thereof and a top web member interconnecting said side plates to overlie the beam member received between said side plates, said bracket further including openings formed through said side plates in alignment with one another, said openings substantially positioned beneath the beam member when said member is received between said side plates and is engaged with said top web;

an extension member comprising a base plate positionable to underlie said top web and adapted to be disposed between said top web and said beam member when said bracket is installed thereon, an intermediate web integrally joined to one end of said base plate and extending perpendicularly upwardly therefrom, and a tongue plate integrally joined to the top of said web and extending perpendicularly laterally therefrom to overlie said support surface;

an eccentric beam support member having a length greater than the distance between said side plates and sized to be received through said openings in said side plates, and beam support member having a camming surface and being rotatable within said openings whereby when said beam member is received between said side plates said beam support member may be rotated to tightly and grippingly lock said beam member between said top web and the camming surface of said support member.

2. A hanger assembly for supporting a beam member from a support surface, said assembly comprising:

a bracket having a pair of parallel side plates spaced apart sufficiently to receive therebetween the beam member at the end thereof and a top web member interconnecting said side plates to overlie the beam member received between said side plates, said bracket further including openings formed through said side plates in alignment with one another, said openings substantially positioned beneath the beam member when said member is received between said side plates and is engaged with said top web;

an extension member associated with said top web and projecting outwardly from said side plates to overlie said support surface;

an eccentric beam support member having a length greater than the distance between said side plates and sized to be received through said openings in said side plates, said beam support member having a camming surface and being rotatable within said openings whereby when said beam member is received between said side plates said beam support member may be rotated to tightly and grippingly lock said beam member between said top web and the camming surface of said support member; and a leveling appliance to overlyingly bear on said support surface, said appliance including a tongue receiving member removably but supportingly connected to said extension member, and adjustment means for selectively varying the elevation of said tongue receiving member above said support surface.

3. The hanger assembly as in claim 2, said tongue receiving member having an internally threaded bore and said adjustment means including a threaded shank disposed within said threaded bore with the lower end of said shank engaging said support surface whereby rotation of said shank imparts vertical displacement to said tongue receiving member.

* * * * *